US007964997B2

(12) United States Patent
Son

(10) Patent No.: US 7,964,997 B2
(45) Date of Patent: Jun. 21, 2011

(54) LIGHTING APPARATUS

(75) Inventor: Won-Kuk Son, Ansan-si (KR)

(73) Assignee: Seoul Semiconductor Co., Ltd., Seoul (KR)

( * ) Notice: Subject to any disclaimer, the term of this patent is extended or adjusted under 35 U.S.C. 154(b) by 31 days.

(21) Appl. No.: 12/569,232

(22) Filed: Sep. 29, 2009

(65) Prior Publication Data

US 2010/0078996 A1 Apr. 1, 2010

(30) Foreign Application Priority Data

Sep. 30, 2008 (KR) ..... 10-2008-0096303

(51) Int. Cl.
*H01H 3/26* (2006.01)

(52) U.S. Cl. ..... 307/157; 362/96

(58) Field of Classification Search ..... 307/18, 307/26, 23, 151, 154, 157, 125, 126, 130; 417/411, 313; 362/96, 800
See application file for complete search history.

(56) References Cited

U.S. PATENT DOCUMENTS 4,974,126 A * 11/1990 Hwang ..... 362/96
2004/0234384 A1* 11/2004 Rardin ..... 417/234
2006/0120063 A1* 6/2006 Lai ..... 362/96
2007/0035134 A1* 2/2007 Bristow ..... 290/1 R
2007/0148012 A1* 6/2007 Hsu ..... 417/313
2009/0262524 A1* 10/2009 Chen ..... 362/192
2009/0297345 A1* 12/2009 Crace ..... 416/5

FOREIGN PATENT DOCUMENTS

WO WO 2009063498 A2 * 5/2009

* cited by examiner

*Primary Examiner* — Jared J Fureman
*Assistant Examiner* — Daniel Cavallari
(74) *Attorney, Agent, or Firm* — H.C. Park & Associates, PLC

(57) ABSTRACT

A lighting apparatus comprises a power unit, a fan unit, a charging unit, a light source unit and a control unit. The power unit receives power from an external power source. The fan unit is rotated using the power supplied from the power unit. The charging unit stores power generated from rotation of the fan unit. The light source unit generates light. The light source unit employs an LED as a light source. The control unit connects the light source unit to the charging unit when power level of the charging unit is greater than a specified level, and the control unit connects the light source unit to the power unit when the power level of the charging unit is lower than the specified level. Therefore, power consumed by the lighting apparatus is reduced and vibration resistance of the lighting apparatus is improved.

20 Claims, 3 Drawing Sheets

LIGHTING APPARATUS

CROSS REFERENCE TO RELATED APPLICATION

This application claims priority from and the benefit of Korean Patent Application No. 2008-96303, filed on Sep. 30, 2008, which is hereby incorporated by reference for all purposes as if fully set forth herein.

BACKGROUND OF THE INVENTION

1. Field of the Invention

Exemplary embodiments of the present invention relate to a lighting apparatus and, more particularly, a lighting apparatus with improved power saving and vibration resistance.

2. Discussion of the Background

A commonly used lighting apparatus may have various functions in consideration in a small size room.

In general, a ceiling fan is used to provide a room with light and ventiation. The ceiling fan employs a fan blade to ventilate a room, and at least one light source to provide light to the room.

A conventional ceiling fan includes an incandescent lamp or a fluorescent lamp as a light source. However, the incandescent lamp or the fluorescent lamp has a glass bulb or glass tube, which is vulnerable to vibration induced by rotation of the fan. In other words, if a crack forms in the glass bulb or the glass tube, no matter how small, the crack may continue to expand because of the fan's vibration. Simple thing to use less words.

In addition, the conventional ceiling fan requires energy to power the fan blade and the light source, thereby increasing the device's overall power consumption.

SUMMARY OF THE INVENTION

Exemplary embodiments of the present invention provide a lighting apparatus with improved power savings and vibration resistance.

Additional features of the invention will be set forth in the description which follows, and in part will be apparent from the description, or may be learned by practice of the invention.

An exemplary embodiment of the present invention discloses a lighting apparatus comprising a power unit to receive power from an external power source; a fan unit to be rotated with the power supplied from the power unit; a charging unit to store power generated from rotation of the fan unit; a light source unit to generate light; and a control unit to control a connection between the charging unit and the light source unit and to control the connection between the power unit and the light source unit, wherein the control unit connects the charging is unit to the light source unit when the power level of the charging unit is greater than a specified level, and the control unit connects the power unit to the light source unit when the power level of the charging unit is less than the specified level.

An exemplary embodiment of the present invention also discloses a lighting apparatus comprising a power unit; a fan unit disposed below the power unit; a charging unit disposed below the fan unit; a control unit disposed below the charging unit; and a light source unit disposed below the control unit, wherein the control unit connects the charging unit to the light source unit when the power level of the charging unit is greater than a specified level, and the control unit connects the power unit to the light source unit when the power level of the charging unit is less than the specified level.

An exemplary embodiment of the present invention also discloses a lighting apparatus comprising a power unit to receive power from an external power source; a fan unit to be rotated with the power supplied from the power unit; a charging unit to store power generated from rotation of the fan unit; and a light source unit to generate light; and a control unit, wherein the control unit connects the charging unit to the light source unit when the power level of the charging unit is greater than a specified level, and the control unit connects the power unit to the light source unit when the power level of the charging unit is less than the specified level.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further is understanding of the invention and are incorporated in and constitute a part of this specification, illustrate embodiments of the invention, and together with the description serve to explain the principles of the invention.

DETAILED DESCRIPTION OF THE ILLUSTRATED EMBODIMENTS

Figure 1:
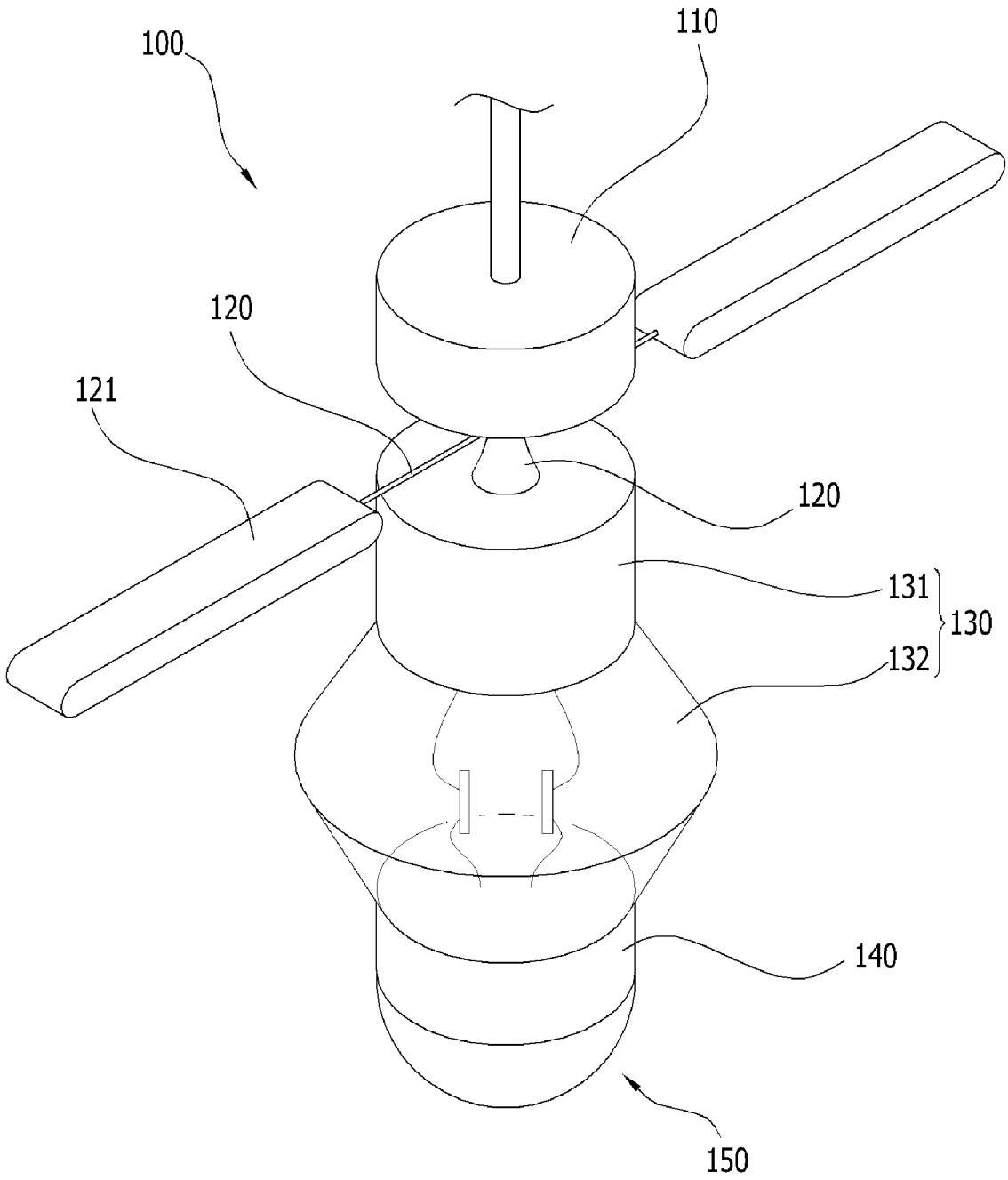
FIG. 1 is a perspective view illustrating a lighting apparatus according to an exemplary embodiment of the present invention.

The invention is described more fully hereinafter with reference to the accompanying drawings, in which embodiments of the invention are shown. This invention may, however, be embodied in many different forms and should not be construed as limited to the embodiments set forth herein. Rather, these exemplary embodiments are provided so that this disclosure is thorough, and will fully convey the scope of the invention to those skilled in the art. In the drawings, the size and relative sizes of layers and regions may be exaggerated for clarity. Like reference numerals in the drawings denote like elements.

It will be understood that when an element or layer is referred to as being "on" or "connected to" another element or layer, it can be directly on or directly connected to the other element or layer, or intervening elements or layers may be present. In contrast, when an element is referred to as being "directly on" or "directly connected to" another element or layer, there are no intervening elements or layers present.

FIG. 1 is a perspective view illustrating a lighting apparatus according to an is exemplary embodiment of the present invention.

Referring to FIG. 1, a lighting apparatus 100 comprises a power unit 110, a fan unit 120, a light source unit 150, a charging unit 130, and a control unit 140.

The power unit 110 receives an external power to rotate the fan unit 120. The fan unit 120 is connected to the power unit 110 to be rotated. The charging unit 130 stores power generated from rotation of the fan unit 120. That is, the charging unit 130 stores electric energy by converting the rotational mechanical energy of the fan unit 120 into electric energy. The light source unit 150 generates light. The control unit 140 electrically connects the light source unit 150 to the charging unit 130 when electric power of the charging unit 130 is greater than a specified level. On the other hand, the control unit 140 electrically connects the light source unit 150 to the power unit 110 when the electric power of the charging unit 130 is less than the specified level. When the electric power of the charging unit 130 is equal to the specified level, the control unit 140 may electrically connect the light source unit 150 to the charging unit 130. Alternatively, when the electric power of the charging unit 130 is equal to the specified level, the control unit 140 may electrically connect the light source unit 150 to the power unit 110.

For example, the power unit 110 may comprise a motor (not shown) such as a DC brush motor, a BLDC motor, etc. for rotating a fan blade 121.

The fan unit 120 may be disposed under the power unit 110. The fan unit 120, comprising at least one fan blade 121, is connected to the power unit 110, and the fan blade 121 may extend substantially parallel to a ceiling of a room. The fan blade 121 ventilates the room. The fan blade 121 may have various shapes, for example, such as electric fan blade, ventilation fan blade, etc.

The number of fan blades 121 may be changed variously in consideration of a size is of a room, design, etc.

The charging unit 130 may be disposed under the fan unit 120. The charging unit 130 stores electric energy by converting rotational mechanical energy of the fan unit 120 into electric energy.

The charging unit 130 may comprise a generator unit 131 for converting rotational mechanical energy of the fan unit 120 into electric energy, and a capacitor unit 132 for storing the electric energy.

Figure 2:
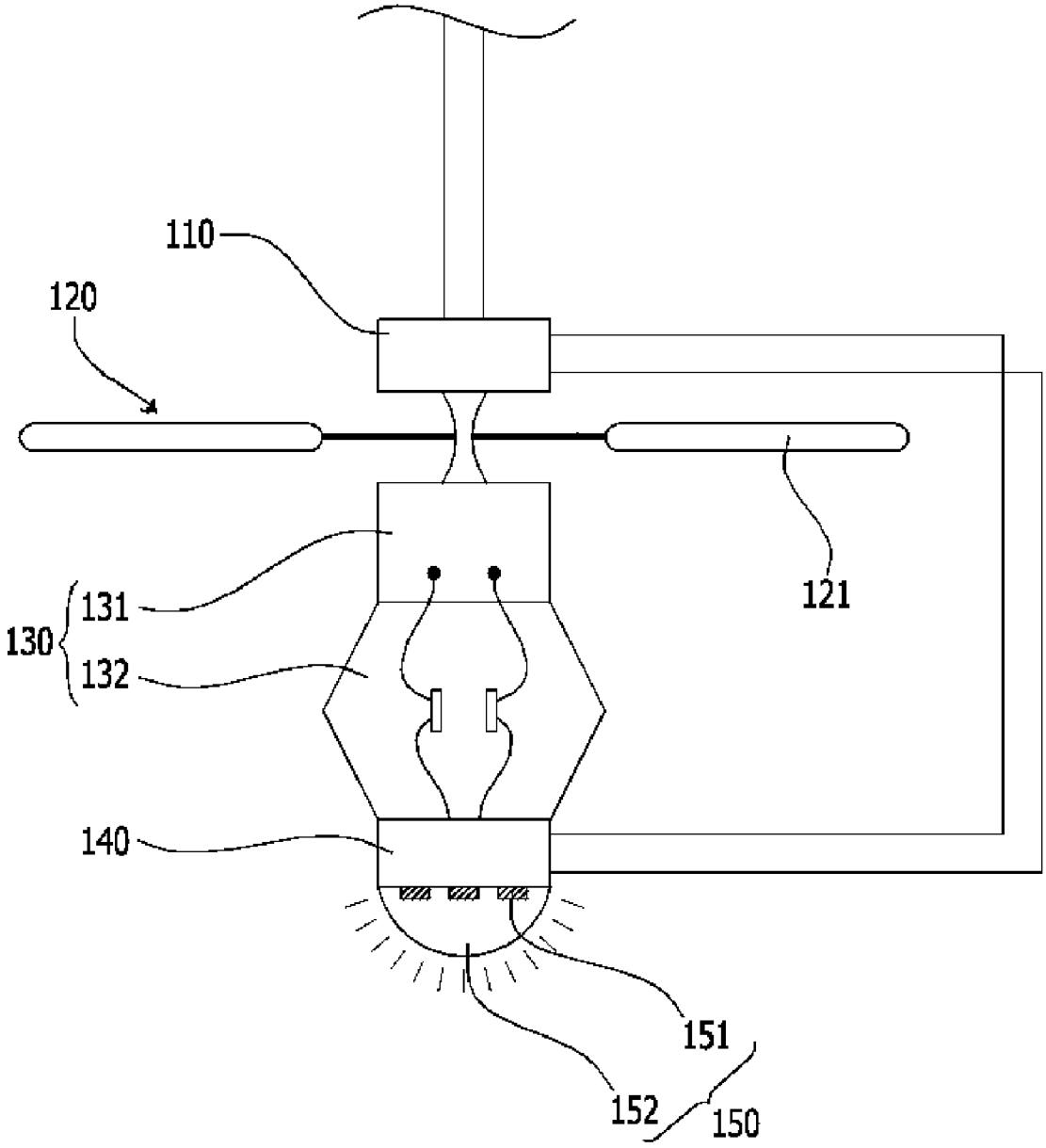
FIG. 2 is a conceptual view of the lighting apparatus in FIG. 1 showing electrical connections between elements.

FIG. 2 is a conceptual view of the lighting apparatus in FIG. 1, showing electrical connections between elements.

Referring to FIG. 2, external electric power is provided to the power unit 110 to rotate the fan blades 121.

The charging unit 130 may comprise the generator unit 131 and the capacitor unit 132. The generator unit 131 converts a portion of the rotational mechanical energy of the fan unit 120 into electricity by using electric energy from the power unit 110.

A direct current generator, a synchronous generator, an induction generator, etc. may be employed as the generator unit 131. For example, a soundproofing direct current generator unit may be employed as the generator unit 131. Preferably, the generator unit 131 has a smaller size, which would enable the lighting apparatus 100 to be attached to a ceiling.

The capacitor unit 132 stores the electric energy generated by the generator unit 131. A capacitance of the capacitor unit 132 may be varied by modifying the dielectric material and employing various kinds of capacitors as the capacitor unit 132.

For example, a vacuum capacitor having vacuum container and electrodes therein, which comprises no dielectric material, an air capacitor using air as the dielectric material, a is metalized paper capacitor enwrapped by a metalized paper, which is formed by evaporating and attaching metal such as zinc, aluminum, etc. in vacuum to a thin paper soaked by paraffin, etc. may be used as the capacitor unit 132.

The control unit 140 measures a voltage of the capacitor unit 132. The control unit 140 electrically connects the light source unit 150 to the capacitor unit 132, when the measured voltage of the capacitor unit 132 exceeds a specified level. On the contrary, when the measured voltage of the capacitor unit 132 is lower than a specified level, the control unit 140 electrically connects the light source unit 150 to the power unit 110 so that electric power may be provided to the light source unit 150. When the measured voltage of the capacitor unit 132 is equal to the specified level, the control unit 140 may electrically connect the light source unit 150 to the charging unit 130. Alternatively, when the measured voltage of the capacitor unit 132 is equal to the specified level, the control unit 140 may electrically connect the light source unit 150 to the power unit 110.

That is, the lighting apparatus 100 is controlled by the control unit 140 such that external electric power of the power unit 110 is provided to the light source unit 150 when the voltage of the capacitor unit 132 is lower than the specified level, and internal electric power stored in the capacitor unit 132 is provided to the light source unit 150 when the voltage of the capacitor unit 132 is higher than the specified level. Additionally, the external electric power of the power unit 110 or the internal electric power of the capacitor unit 132 may be provided to the light source unit 150 when the voltage of the capacitor unit 132 is equal to the specified level.

For example, external power of the power unit 110 rotates the fan blade 121 for ventilation, and power generated by the rotation of the fan blade 121 can be stored by the capacitor unit 132 at daytime. The power stored by the capacitor unit 132 can then be provided is to the light source unit 150 at nighttime.

The light source unit 150 may comprise a light emitting diode (LED) 151 for generating light and an optical cover 152 for improving the optical characteristics of light generated by the LED 151. For example, the optical cover 152 can be used to change the color of light, the brightness of the light, the reflectivity, etc. The LED 151 may be driven by using less energy in comparison with a conventional incandescent lamp or a fluorescent lamp and, therefore, the LED 151 may be driven for a relatively longer time through the capacitor unit 132. Another benefit is that the LED 151 does not have a glass tube or glass bulb. Therefore, even if the LED 151 suffers from vibration, the LED 151 can endure vibration induced by rotation of the fan blade 121.

Figure 3:
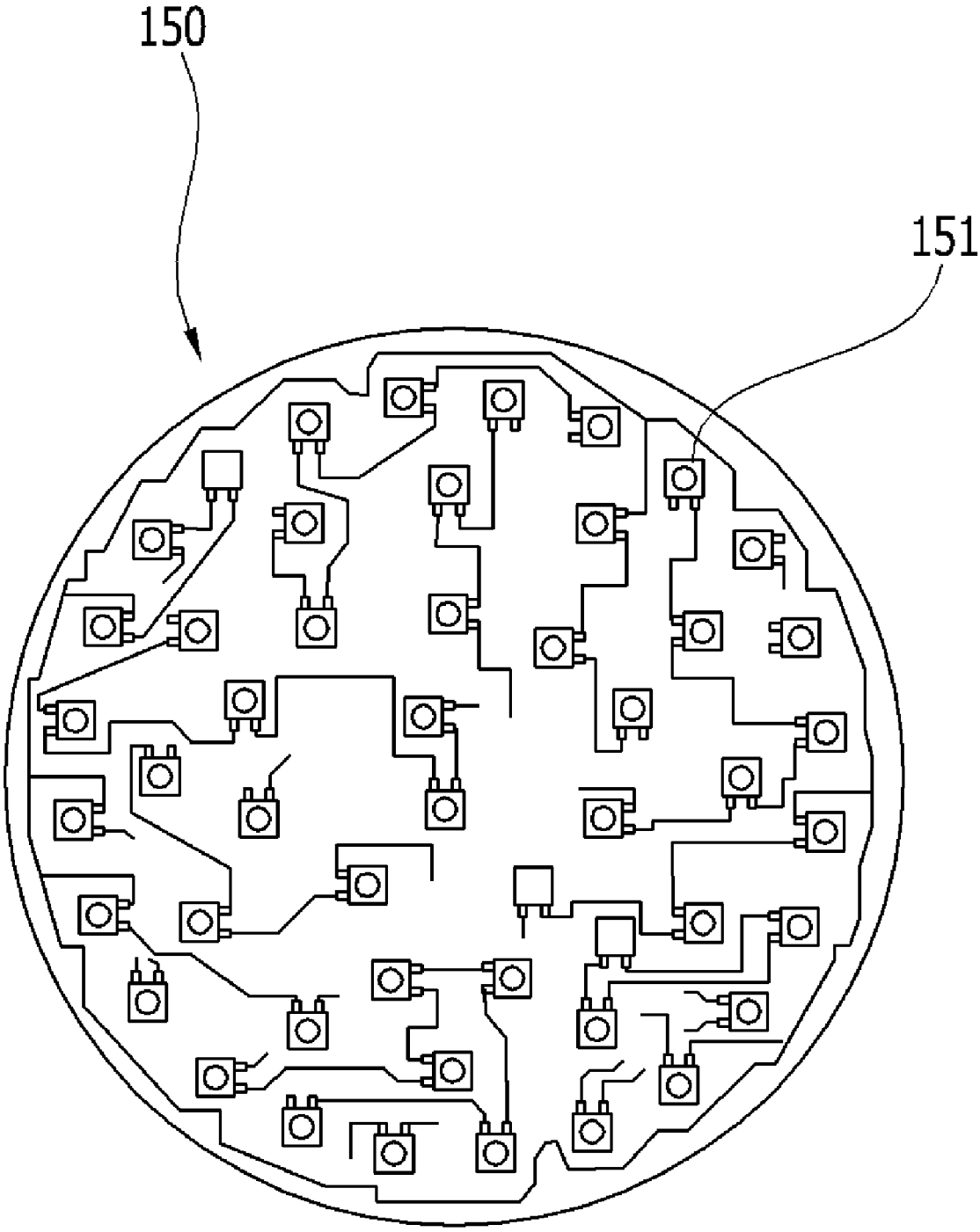
FIG. 3 is a plain view illustrating a lower portion of a light source unit in FIG. 1.

FIG. 3 is a plain view illustrating a lower portion of light source unit 150 in FIG. 1.

Referring to FIG. 3, light source unit 150 may comprise the LED 151 as a light source. The number of LEDs 151 may be adjusted according to a size of the lighting apparatus 100 and a room.

A plurality of LEDs 151 may be arranged according to a regular pattern to provide a uniformly bright light to a room. However, the plurality of LEDs 151 may also be irregularly disposed.

According to exemplary embodiments of the present invention, the electric power consumed by the lighting apparatus is lowered since a portion of the mechanical energy of the fan unit operated for ventilation is converted into electric energy that is used as a power source of the light source unit. Furthermore, since the LED is used in the light source unit, the light source unit becomes vibration resistant because the LED does not have a glass bulb or a glass is tube, which are vulnerable to vibration induced by the power unit and the fan unit.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A lighting apparatus, comprising:

a power unit to receive power from an external power source;

a fan unit to rotate in response to power supplied from the power unit;

a charging unit to store power generated from rotation of the fan unit;

a light source unit to generate light; and a control unit to control a connection between the charging unit and the light source unit and to control a connection between the power unit and the light source unit, wherein the control unit connects the charging unit to the light source unit when a power level of the charging unit exceeds a first level, and the control unit connects the power unit to the light source unit when the power level of the charging unit is less than the first level.

2. The lighting apparatus of claim 1, wherein the control unit connects the charging unit to the light source unit when the power level of the charging unit is equal to the first level.

3. The lighting apparatus of claim 1, wherein the control unit connects the power unit to the light source unit when the power level of the charging unit is equal to the first level.

4. The lighting apparatus of claim 1, wherein the power unit comprises an electric power unit.

5. The lighting apparatus of claim 1, wherein the charging unit comprises a generator unit to convert mechanical energy of the fan unit into electric power and a capacitor unit to store the electric power generated by the generator unit.

6. The lighting apparatus of claim 1, wherein the light source unit comprises a light emitting diode (LED).

7. The lighting apparatus of claim 6, wherein the light source unit further comprises an optical cover to control characteristics of light generated by the LED.

8. The lighting apparatus of claim 1, wherein the fan unit comprises at least one fan blade, and the fan unit is disposed under the power unit.

9. A lighting apparatus, comprising:

a power unit;

a fan unit disposed below the power unit;

a charging unit disposed below the fan unit;

a control unit disposed below the charging unit; and a light source unit disposed below the control unit, wherein the control unit connects the charging unit to the light source unit when a power level of the charging unit is greater than a first level, and the control unit connects the power unit to the light source unit when the power level of the charging unit is less than the first level.

10. The lighting apparatus of claim 9, wherein the control unit connects the charging unit to the light source unit when the power level of the charging unit is equal to the first level.

11. The lighting apparatus of claim 9, wherein the control unit connects the power unit to the light source unit when the power level of the charging unit is equal to the first level.

12. The lighting apparatus of claim 9, wherein the power unit comprises an electric power unit.

13. The lighting apparatus of claim 9, wherein the charging unit comprises a generator unit to convert mechanical energy of the fan unit into electric power and a capacitor unit to store the electric power generated by the generator unit.

14. The lighting apparatus of claim 9, wherein the light source unit comprises a light emitting diode (LED).

15. The lighting apparatus of claim 14, wherein the light source unit further comprises an optical cover to control characteristics of light generated by the LED.

16. The lighting apparatus of claim 9, wherein the fan unit comprises at least one fan blade.

17. A lighting apparatus, comprising:

a power unit to receive power from an external power source;

a fan unit to rotate in response to power supplied from the power unit;

a charging unit to store power generated from rotation of the fan unit; and a light source unit to generate light; and a control unit to selectively connect the charging unit or the power unit to the light source unit.

18. The lighting apparatus of claim 17, wherein the control unit connects the charging unit to the light source unit when a power level of the charging unit is greater than a first level, and the control unit connects the power unit to the light source unit when the power level of the charging unit is less than the first level.

19. The lighting apparatus of claim 18, wherein the control unit connects the charging unit to the light source unit when the power level of the charging unit is equal to the first level.

20. The lighting apparatus of claim 18, wherein the control unit connects the power unit to the light source unit when the power level of the charging unit is equal to the first level.

* * * * *